United States Patent [19]

Wratschko

[11] 4,332,321

[45] Jun. 1, 1982

[54] SHAVING KIT

[76] Inventor: Otto Wratschko, 4117 N. Broadway, Chicago, Ill. 60613

[21] Appl. No.: 202,720

[22] Filed: Oct. 31, 1980

Related U.S. Application Data

[63] Continuation-in-part of Ser. No. 68,861, Dec. 12, 1979.

[51] Int. Cl.[3] ..... A45C 11/00; B26B 19/38

[52] U.S. Cl. ..... 206/228; 206/38; 30/47; 30/86

[58] Field of Search ..... 206/228, 349, 38; 30/86, 87, 47, 41

[56] References Cited

U.S. PATENT DOCUMENTS

| | | | |
|---|---|---|---|
| 2,725,626 | 12/1955 | Baker | 30/86 |
| 2,820,288 | 1/1958 | Malecki | 30/87 |
| 3,349,484 | 10/1967 | Zeles | 30/86 |
| 4,074,428 | 2/1978 | Roberts | 30/86 |

*Primary Examiner*—William T. Dixson, Jr.

*Attorney, Agent, or Firm*—Robert E. Browne; Stephen R. Arnold

[57] ABSTRACT

A portable shaving kit includes a tubular member having a socket opening and one end with a support arm having a socket within the socket opening. The support arm is movable between stored and operative positions and is held in two positions by a spring-biased detent and has a blade support at the outer end thereof. The blade support is pivoted between the stored and operative positions so that the blade can be housed in a hollow cap during storage.

4 Claims, 4 Drawing Figures

SHAVING KIT

REFERENCE TO RELATED APPLICATIONS

This application is a continuation-in-part of U.S. Ser. No. 68,861 filed Dec. 12, 1979.

TECHNICAL FIELD

The present invention relates generally to shaving kits and, more particularly, to a compact shaving kit that can be carried with the person and contains all of the shaving materials.

BACKGROUND PRIOR ART

Numerous proposals have been suggested for a portable shaving kit which can be carried in a pocket and includes all of the necessary items, such as the safety razor blade and the shaving cream. Examples of such devices are disclosed in U.S. Pat. Nos. 1,392,753; 2,429,352; 2,454,374; 2,599,019; 3,818,872; and 3,985,146.

While the patented prior art in replete with suggestions of a portable safety razor kit, none of these devices have obtained any degree of commercial success. While not exactly known, it is believed that one of the reasons for the lack of commercial success of the patented prior art devices is the fact that the safety razor is not at a fixed and comfortable angle with respect to the handle portion of the kit. Users of a conventional safety razor have become accustomed to having the blade extend perpendicularly to the handle and have the blade supported at an angle of approximately 45° with respect to the axis of the handle.

SUMMARY OF THE INVENTION

According to the present invention, a portable pen-type shaving kit has been developed which can be carried in a stored position in the same manner as a conventional pen or pencil and can easily be converted to a position wherein the handle portion of the kit is at the most comfortable angle with respect to the blade support portion of the kit.

More specifically, the shaving kit of the present invention includes an elongated hollow tubular member that has a socket opening at one end with an elongated support arm having a socket at one end disposed in the socket opening. The socket has two angularly flat portions which cooperate with a spring-biased detent to define a first stored position for the support arm axially aligned with the tubular member and a second operative position angularly related to the axis of the tubular member. An elongated blade support is pivotedly supported on the outer end of the support arm and is movable between a stored position generally aligned with the axis of the elongated arm and an operative position extending generally perpendicular to the elongated support arm. The tubular member also has a fixed abutment defining the second position for the elongated support arm so that the support arm and tubular member, which constitutes the handle of the razor blade, define a rigid operative position for the razor blade which is most comfortable for a user.

The elongated tubular member preferably has an opposite open end adapted to receive shaving cream with a cap adapted to retain the shaving cream, preferably in the form of pellets, within the open end.

When the shaving kit is desired to be stored, the elongated blade support is pivoted into alignment with the elongated arm and both are pivoted to a first position axially aligned with the tubular member so that a hollow cap can be telescoped over the two and be releasably retained on the periphery of the tubular member.

BRIEF DESCRIPTION OF SEVERAL VIEWS OF DRAWINGS

DETAILED DESCRIPTION

Figure 1:
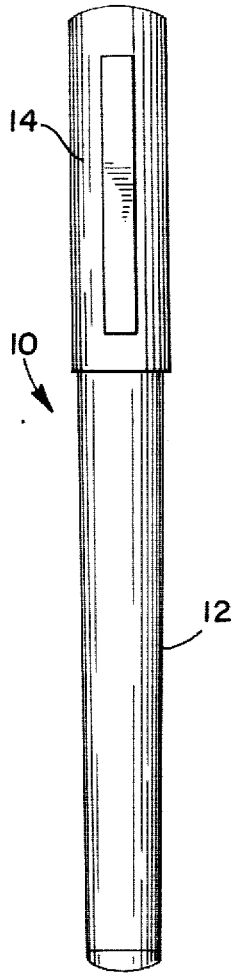
FIG. 1 is a plan view of the shaving kit in its stored condition.

While this invention is susceptible of embodiment in many different forms, there is shown in the drawings and will herein be described in detail a preferred embodiment of the invention with the understanding that the present disclosure is to be considered as an exemplification of the principle of the invention to the embodiment illustrated.

FIG. 1 of the drawings generally discloses a shaving kit constructed in accordance with the present invention and designated by reference numeral 10. Shaving kit 10 consists of a hollow generally tubular member 12 that has a hollow cap 14 adapted to be telescoped over one end thereof, as will be explained later.

Hollow tubular member 12 has a member or insert at one end thereof with a socket opening 22 defined within member 20. Member 20 has an opening 24 extending to one side thereof and also has a fixed abutment 26 which preferably defines a surface that extends substantially perpendicular to the elongated axis of hollow tubular member 12.

Figure 2:
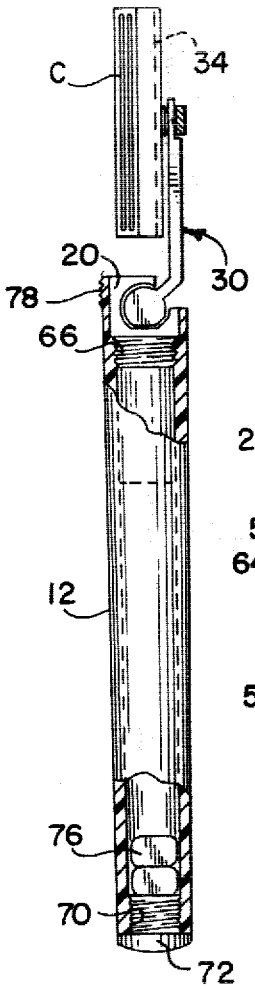
FIG. 2 is a view similar to FIG. 1 with the cap removed and portions thereof shown in cross-section.
Figure 4:
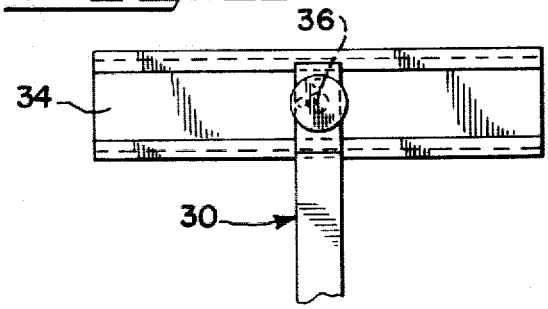

An elongated support arm 30 has a socket 32 at one end thereof which is adapted to be rotatably supported within the socket opening 22. An elongated blade support 34 is pivoted on the outer end of support arm 30 and is pivotable between a first stored position illustrated generally in FIG. 2 wherein the elongated axes of the support arm and blade support are aligned with each other and a second position wherein the elongated blade support 34 extends substantially perpendicular to the axis of support arm 30, as illustrated in FIG. 4. It should be noted that the arm and blade support have a transverse dimension that is less than the diameter of tubular member 12 and are within the peripheral confines of tubular member in the stored position.

Figure 3:
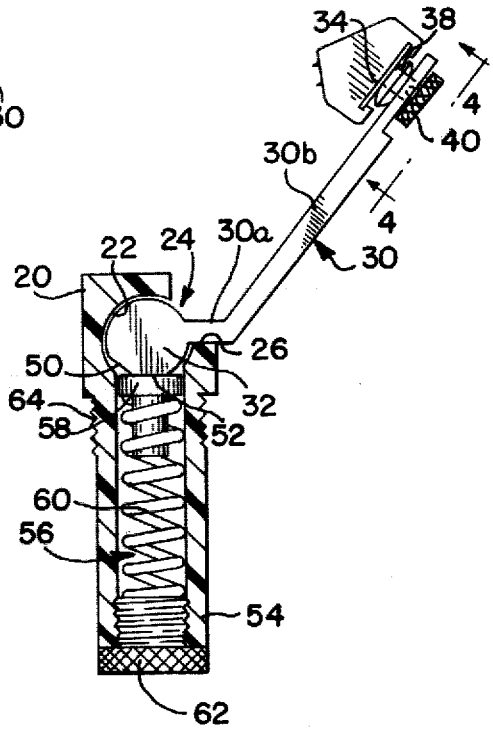
FIG. 3 is a fragmentary view similar to FIG. 2 showing the shaving kit in an operative position; and, FIG. 4 is a fragmentary view as viewed generally along line 4—4 of FIG. 3.

As more clearly illustrated in FIGS. 3 and 4, the pivotal connection for blade support 34 preferably includes a pin 36 extending from a surface of blade support 34 through an opening at the outer end of arm 30. A pair of Bellville spring washers 38 are interposed between adjacent surfaces of blade support 34 and support arm 30 and a cap 40 is secured to the outer end of pin 36. Suitable detents may be provided between blade support 34 and support arm 30 to define the two positions for blade support 34. Thus, the washers can be compressed to accomodate the 90° rotation and the blade is held in the respective positions by the detents (not shown).

Preferably, blade support is configured so as to receive a conventional twin steel blade cartridge that is commercially available and manufactured by several sources. Such twin blade cartridge usually has a substantially T-shaped slot in the body thereof, as illustrated in FIG. 3, and blade support 34 is configured to be received into the T-shaped slot.

According to one aspect of the invention, the tubular member and socket cooperate with each other to define two fixed positions for the support arm with respect to the elongated tubular member 12.

As illustrated in detail in FIG. 3, socket 32 has two angularly related flat surfaces 50 and 52, while member 20 has an elongated tubular portion 54 extending therefrom. A spring-biased detent means 56 is located within opening 54 and consists of a detent element 58 and a coil spring 60. One end of the coil spring 60 engages a threaded cap 62 which is received into the open end of the tubular portion 54 to bias detent 58 toward socket 32. Thus, spring 60 biases detent 58 toward socket 60 and cooperates with flat surfaces 50 and 52 to define the two positions for support arm 30. The upper end of tubular portion 54 has threads 64 defined thereon which cooperate with internal threads 66 (FIG. 2) at the upper end of tubular member 12. Thus, member 20 can be permanently secured into the upper open end of tubular member 12.

The opposite end of tubular member 12 also has an opening and has an internal thread 70 which receives a threaded cap 72. The tubular portion 12 can thus be utilized for storing shaving cream pellets 76, as well as extra blades.

The manipulation and use of the unique shaving kit is believed to be apparent from the above description, but will be briefly summarized. In the normal stored and carrying position, the blade support 34 and support arm 30 are in the position illustrated in FIG. 2 wherein the elongated axes of both members are generally aligned with the axis of tubular member 12 and have transversed dimensions that are less than the diameter of the tubular member 12. With such arrangement, hollow cap 14 can be telescoped over the two members and can be releaseably retained on tubular member by cooperating threads 78 (only one being shown in FIG. 2). Of course, it will be appreciated that the cap 14 also has internal threads to be received onto thread 78. When it is desired to utilize the shaving kit, cap 14 is removed, blade support with the conventional cartridge C thereon is rotated 90° from the position illustrated in FIG. 2 to that illustrated in FIG. 4 wherein the blade support and blade extends substantially perpendicular to support arm 30. The support arm is then pivoted approximately 45° from the first position illustrated in FIG. 2 to the second position illustrated in FIG. 3 during which spring 60 is compressed and ultimately forces detents 58 into engagement with flat surface 52. In this position, the first portion **30*a* of arm 30 is in engagement with abutment 26 to define a rigid position for the shaving blade with respect to tubular member or handle 12. In this position, the second portion 30*b* of arm 30 extends at an angle of approximately 45° with respect to the axis of tubular member or handle 12, which is the preferred angular relationship between the blade and the handle. It should be noted at this point that the first portion 30*a* and the second portion 30*b* of arm 30 define an angular relationship which corresponds to the angular relationship between flat surfaces 50 and 52 which in turn define the two positions for support arm 30**.

As can be appreciated from the above description, the present invention provides a unique portable system which is a small slender object that can be carried in the pocket of a user and will appear as a writing instrument. However, the unit is available at all times for the user and can easily be transformed to a conventional safety razor by manipulation of two parts. The added benefit is that the shaving cream is preferably in the form of tablet 76 which can be stored in the hollow tube 12 until needed. Additional blades (not shown) could also be stored in the tubular member.

I claim:

1. A shaving kit comprising an elongated handle member defining a gripping axis and having a socket opening at one end, an elongated support arm having a socket member at one end disposed in and movably captured by said socket opening, position defining means between said socket member and said handle member for defining first and second angular positions of the axis of said support arm respectively generally aligned with said gripping axis of said handle member and angularly related to said gripping axis, and an elongated blade support pivotally supported on an outer end of said elongated support arm and pivotable between a first stored position generally aligned with said axis of said elongated support arm and a second operative position extending generally perpendicular to said elongated support arm, the length of said support arm and the angle of said second angular position configured to place said blade support substantially away from said gripping axis, whereby a blade inserted in said blade support is positionable to facilitate case ease of shaving.

2. A shaving kit as defined in claim 1 in which said position defining means for said support arm includes a movable detent means in communication with said socket opening, biasing means between said handle member and said detent means, said biasing means biasing said detent means into contact with said socket member, angularly related detent engaging portions on said socket member engagable by said detent means to define said first and second angular positions, and an abutment on said handle member aligned with the path of movement of said support arm, said abutment and a portion of said support arm configured and disposed to arrestingly contact each other when said support arm is disposed in said second angular position to provide additional support for said support arm.

3. A shaving kit as defined in claim 2, in which said handle member is hollow and substantially circular in cross-section and said elongated support arm and said elongated blade support have a transverse dimension less than the peripheral diameter of said handle member and located within the periphery of said handle member when said support arm is in said first position and said elongated blade support is in said first stored position, further including a hollow cap adapted to be telescoped over said support arm and blade support and releasably retained on said handle member.

4. The shaving kit of claims 2 or 3 wherein said detent engaging portions on said socket member are flat portions, said detent means is a piston, and said biasing means is a spring.

* * * * *